US007494090B2

(12) United States Patent
Leal et al.

(10) Patent No.: US 7,494,090 B2
(45) Date of Patent: Feb. 24, 2009

(54) MULTIPLE KILL VEHICLE (MKV) INTERCEPTOR WITH AUTONOMOUS KILL VEHICLES

(75) Inventors: Michael A. Leal, Tucson, AZ (US); Todd L. Baker, Green Valley, AZ (US); Kent P. Pflibsen, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/678,456

(22) Filed: Feb. 23, 2007

(65) Prior Publication Data

US 2008/0093498 A1 Apr. 24, 2008

Related U.S. Application Data

(60) Provisional application No. 60/777,880, filed on Mar. 1, 2006.

(51) Int. Cl.

| | |
|---|---|
| ***F41G 7/00*** | (2006.01) |
| ***F42B 15/01*** | (2006.01) |
| ***F42B 15/10*** | (2006.01) |
| *F42B 15/00* | (2006.01) |

(52) U.S. Cl. ..... 244/3.16; 244/3.1; 244/3.15; 244/3.17; 244/3.18; 244/3.21; 244/3.22; 244/158.1; 89/1.11; 701/200; 701/207; 701/222; 102/473; 102/489; 342/52; 342/53; 342/54; 342/61; 342/62; 342/175; 342/195

(58) Field of Classification Search ..... 244/3.1–3.3, 244/158.1; 89/1.11; 342/61–68, 175, 195, 342/52–55; 701/200, 207, 213–216, 220–226, 701/300–302; 102/473, 475, 476, 489
See application file for complete search history.

(56) References Cited

U.S. PATENT DOCUMENTS

| | | | | |
|---|---|---|---|---|
| 4,738,411 | A | 4/1988 | Ahlstrom | |
| 4,796,834 | A | 1/1989 | Ahlstrom | |
| 4,925,129 | A | 5/1990 | Salkeld | |
| 5,260,709 | A * | 11/1993 | Nowakowski | 342/62 |
| 6,481,666 | B2 * | 11/2002 | Frucht | 244/3.15 |
| 6,549,158 | B1 * | 4/2003 | Hanson | 342/62 |
| 6,563,450 | B1 * | 5/2003 | Wallace | 342/62 |
| 6,603,421 | B1 * | 8/2003 | Schiff et al. | 342/62 |
| 6,817,568 | B2 * | 11/2004 | Spate et al. | 244/3.15 |
| 2001/0025901 | A1 * | 10/2001 | Frucht | 244/3.15 |
| 2004/0169107 | A1 * | 9/2004 | Spate et al. | 244/3.1 |

* cited by examiner

*Primary Examiner*—Bernarr E Gregory
(74) *Attorney, Agent, or Firm*—The Noblitt Group, PLLC

(57) ABSTRACT

The present invention provides a MKV interceptor including multiple kill vehicles with autonomous management capability and kinematic reach to prosecute a large threat extent. Each KV can self-manage its own KV deployment and target engagement for a determined target volume assigned by a designated master KV. At least one KV is master capable of managing the post-separation of all of the KVs without requiring updates to the mission plan post-separation. The autonomous capability and increased kinematic reach provides for a more efficient use of boosters and more effective engagement of the threat.

24 Claims, 12 Drawing Sheets

300

| PERCENTAGES OF SINGLE KV | | | | | | | | |
|---|---|---|---|---|---|---|---|---|
| SUBSYSTEM | UKV (KG) | UKV (%) | | CV-KV (KG) | CV-KV (%) | | A-MKV (KG) | A-MKV (%) |
| DACS + STRUCT + COVERS | 18.31 | 27.65 | | 3.00 | 25.75 | | 10.45 | 35.84 |
| FUEL / OXIDIZER | 15.15 | 22.87 | | 1.80 | 15.45 | | 5.60 | 19.20 |
| PASSIVE EO SENSOR | 6.20 | 9.36 | | 1.99 | 17.10 | | 2.81 | 9.64 |
| ACTIVE SENSOR | 0.00 | 0.00 | | 0.00 | 0.00 | | 0.00 | 0.00 |
| CRYO GAS SUPPLY | 4.00 | 6.04 | | 0.00 | 0.00 | | 0.00 | 0.00 |
| SENSOR COVER | 0.00 | 0.00 | | 0.00 | 0.00 | | 0.00 | 0.00 |
| GEU + ECU | 6.89 | 10.40 | | 2.20 | 18.88 | | 3.68 | 12.62 |
| HARNESSES | 5.20 | 7.85 | | 0.45 | 3.86 | | 0.90 | 3.09 |
| BATTERY | 1.87 | 2.82 | | 0.70 | 6.01 | | 1.40 | 4.80 |
| COMMUNICATION | 2.40 | 3.62 | | 0.41 | 3.52 | | 0.41 | 1.41 |
| GPS | 0.00 | 0.00 | | 0.00 | 0.00 | | 0.23 | 0.79 |
| INERTIAL MEASUREMENT UNIT | 1.35 | 2.04 | | 0.35 | 3.00 | | 0.73 | 2.50 |
| TELEMETRY | 0.86 | 1.30 | | 0.00 | 0.00 | | 0.00 | 0.00 |
| BALLAST / MARGIN | 4.00 | 6.04 | | 0.75 | 6.44 | | 2.95 | 10.12 |
| | | | | | 0.00 | | | |
| SINGLE KV TOTAL = | 66.23 | 100.00 | | 11.65 | 100.00 | | 29.16 | 100.00 |
| | | | | | | | | |
| PERCENTAGES OF TOTAL PAYLOAD | | | | | | | | |
| NUMBER OF KV'S | 1.00 | | | 14.00 | | | 7.00 | |
| SENSOR COVER WEIGHT | 1.50 | | | 0.55 | | | 1.10 | |
| KV TOTAL = | 67.73 | 70.02 | | 170.83 | 45.44 | | 211.82 | 70.04 |
| | | | | | 0.00 | | | 0.00 |
| CV SENSOR | 0.00 | 0.00 | | 10.80 | 2.87 | | 0.00 | 0.00 |
| TARGET DESIGNATOR | 0.00 | 0.00 | | 22.00 | 5.85 | | 0.00 | 0.00 |
| CV PROPULSION | 0.00 | 0.00 | | 60.50 | 16.09 | | 0.00 | 0.00 |
| GAS SUPPLY WEIGHT | 6.00 | 6.20 | | 12.00 | 3.19 | | 12.00 | 3.97 |
| SPACE TO GROUND COMM | 0.00 | 0.00 | | 2.80 | 0.74 | | 2.80 | 0.93 |
| AVIOINICS WEIGHT | 5.00 | 5.17 | | 7.00 | 1.86 | | 5.80 | 1.92 |
| SUPPORT STRUCT WEIGHT | 18.00 | 18.61 | | 90.00 | 23.94 | | 70.00 | 23.15 |
| | | | | | 0.00 | | | 0.00 |
| PAYLOAD TOTAL = | 96.73 | 100.00 | | 375.93 | 100.00 | | 302.42 | 100.00 |

FIG.9

MULTIPLE KILL VEHICLE (MKV) INTERCEPTOR WITH AUTONOMOUS KILL VEHICLES

CROSS-REFERENCE TO RELATED APPLICATIONS

This application claims benefit of priority under 35 U.S.C. 119(e) to U.S. Provisional Application No. 60/777,880 entitled "Interceptor System and Method Using Multiple Unitary-Capable Kill Vehicles on a Single Booster" and filed on Mar. 1, 2006, the entire contents of which are incorporated by reference.

BACKGROUND OF THE INVENTION

1. Field of the Invention

This invention relates to missile defense systems, and in particular, but not exclusively, to a system for intercepting and destroying exo-atmospheric missiles using kinetic energy kill vehicles.

2. Description of the Related Art

Ballistic missiles armed with conventional explosives, chemical, biological or nuclear warheads represent a real and growing threat to the United States from the former Soviet Union, terrorist states and terrorist groups. The technologies required to both create weapons of mass destruction (WMD) and to deliver them over hundreds to thousands of miles are available and being aggressively sought by enemies of the United States.

Several modern missile defense systems are under development by branches of the US Armed Services and Department of Defense. These systems use an (interceptor) missile to destroy an incoming (target) missile, warhead, reentry vehicle, etc. . . . Blast-fragmentation systems detonate high power explosives shortly before the collision of the interceptor with the target. Kinetic energy systems rely solely on the kinetic energy of the interceptor to destroy the target. Both systems require highly sophisticated guidance systems to acquire and track the target. In particular, kinetic energy systems must hit the target with great precision.

U.S. Pat. Nos. 4,738,411 and 4,796,834 to Ahlstrom describe techniques for guiding explosive projectiles toward the target. In the '411 patent, the magazine is loaded with transmitting projectiles with means for illuminating the target with electromagnetic radiation and explosive projectiles with a passive or purely receiving homing device. During the last part of its travel, the transmitting projectile illuminates the target area with electromagnetic energy. A preferred wavelength range is the so called millimeter wavelength range, suitably 3-8 mm. Energy reflected off of any targets within the target area is received by the explosive projectiles and used to guide the projectiles toward the target. A leading projectile passively detects and then illuminates a target. A trailing projectile detects the return energy off of the illuminated target and corrects its trajectory accordingly. When the leading projectile hits the ground, the trailing projectile senses the interruption and resets itself to passive detection. When the target's own radiation is detected, the passive signature is used for final guidance. The detector device for activating the illumination source is preferably the same detector as that included in the target tracking device.

Raytheon has fielded a unitary Kill Vehicle system that represents state-of-the-art in kinetic energy systems designed to locate, track and collide with a ballistic missile. The unitary interceptor includes a single kill vehicle (KV). The interceptor is launched on a multi-stage rocket booster. Current versions of the kill vehicle have large aperture optical sensors to support the endgame functions including: acquisition of the target complex, resolution of the objects, tracking the credible objects, discrimination of the target objects and homing in on the target warhead.

The deployment of missiles with Multiple Independently Targeted Re-entry Vehicles (MIRVs) and advanced decoys is driving a move to develop interceptors that can deploy multiple kill vehicles. A multiple kill vehicle (MKV) interceptor would include a carrier vehicle (CV) and multiple KVs. There is a strong desire to use the existing base of booster stages to deploy the MKVs and to maintain compatibility with existing command, control, and communication infrastructure and Built-in Test (BIT) procedures. The development of an MKV interceptor presents unique problems of weight, miniaturization, and control bandwidth to acquire, track and intercept multiple targets in addition to all the issues encountered by unitary interceptors. Consequently, an effective MKV interceptor has not yet been developed or deployed.

One concept being pursued is to simply miniaturize existing unitary interceptors. In this approach, each KV includes all of the intelligence needed to discriminate targets and provide guidance to impact. The CV is merely a bus to transport the KVs from launch to release. Unfortunately, the ability to "miniaturize" all the functionality into a small, lightweight KV is well beyond state-of-the-art and may never be realizable due to fundamental physics constraints. For example, the bi-directional space-to-ground data link is dictated by the distance between the KV and the ground station, the ability of the sensor to have adequate detection range and resolution is proportional to the aperture size, and the Focal Plane Assembly (FPA) cryo cooling system is relatively fixed. The mass/power/volume requirements of these crucial subsystems cannot simply be made smaller without a substantial performance penalty.

Another concept is to "command guide" all of the KVs from the CV to impact. In this approach all of the intelligence needed to discriminate targets and provide guidance to impact is located on the CV. The KVs include minimal functionality, typically only a receiver and actuators to respond to the heading commands sent by the CV. U.S. Pat. No. 4,925,129 describes a missile defense system including a guided projectile with multiple sub-projectiles. A radar tracker is used to guide the projectile toward a target at relatively large distances. An optical tracker on the projectile is used to track the target at relatively small distances and issue guidance commands to guide the sub-projectiles to intercept the target. Although conceptually attractive, command guidance suffers from poor target resolution and latency associated with the stand-off range of the CV to keep all targets within the optical tracker's field of regard. Furthermore, the CV must have sufficient bandwidth to track all of the targets simultaneously.

SUMMARY OF THE INVENTION

The present invention provides a MKV interceptor including multiple autonomous kill vehicles (A-MKV), each having kinematic reach to prosecute a large threat cloud extent. The increased kinematic reach provides for a more efficient use of boosters and more effective engagement of the threat. Redundancy provided by multiple autonomous KVs reduces the occurrence of single point failures.

In a fully redundant configuration, each autonomous KV is suitably provided with the capability to manage the deployment of the entire KV cloud to engage the target cloud, the acquisition and divert capability to reach the entire target cloud, and the discrimination and tracking capability to self-manage its assigned mission to engage a determined volume of the target cloud and support unambiguous assignment of targets from the mission plan. Less redundancy can be provided by limiting the number of KVs that are capable of managing the cloud or the number of KVs that can reach the entire cloud. Execution of the mission plan is enhanced with mission updates on target cloud position and target discrimination but failure to receive these updates causes a graceful degradation in performance, not complete mission failure.

To provide an MKV interceptor with large kinematic reach within the available mass/power/volume budgets supported by existing booster capability required an innovative reallocation of the system and individual KV functionality and their mass/power/volume requirements. The KVs are deployed from a non-separating adapter. In general, the mass of the adapter is reduced relative to a CV by not providing the adapter with either the sensor or propulsion capability to remove insertion error. A single bi-directional space-to-ground data link is employed to communicate between the KVs and ground, local space-to-space data links are used to communicate among the KVs. Cryo cooling, power and processor operations that are performed pre-separation are centralized on the adapter, thereby reducing the mass requirements of each KV. These capabilities are suitably provided in an adapter that is designed to interface between the generic KVs and a particular booster. Finally, the discrimination requirements of each KV are limited to simple decoys and debris, the KVs are not required to perform sophisticated discrimination, which reduces the sensor and processing requirements. Unlike the unitary KV, multiple KVs can reduce ambiguity by killing any objects that look like a real target.

In a first aspect of the invention, at least one, suitably multiple and preferably all of the KVs have a guidance system capable of managing post-separation KV deployment and target engagement to execute the mission plan. Once the initial mission plan is uploaded, the KVs can function autonomously and execute the mission plan without any external command and control. The execution of the mission plan may benefit from updated information as to target cloud position or target discrimination but failure to receive such information will only cause graceful degradation, not complete mission failure. The designated master KV assigns each KV a determined target volume of the target cloud and transmits any relevant information including position, target discrimination etc. to the KV. Each KV than performs any divert maneuver necessary to correct for insertion error of the interceptor, acquires the determined target volume and executes its mission plan. Multiple KVs may be assigned to the same target volume and KVs may be retasked as new information is received from the ground or as the master integrates in formation on the target cloud gathered by the individual KVs. This "network centric" approach allows a master KV to deploy the KV cloud to effectively intercept the target cloud.

In a second aspect of the invention, the space-to-ground data link that resides on the unitary KV is not replicated on each of the multiple KVs. Instead a single transceiver is positioned on either one of the KVs or the adapter thereby reducing the mass/power/volume requirements of the interceptor and most if not all of the individual KVs. If the transceiver is positioned on the adapter, the adapter is also provided with a space-to-space data link to transmit the updated mission plan to at least the designated master KV and receive mission information. If the transceiver is positioned on one KV, that KV is suitably the first designated master KV. To compensate for the increased mass/power/volume, that KV may be provided with less propellant and assigned the closest part of the target cloud.

In a third aspect of the invention, a bulk of the sensor cryo-cooling system is moved from each KV to the adapter. Cryo-cooling is required for infra-red passive sensor performance on-board each KV. The adapter is provided with the pressurized gas bottles, valves and so forth, which are configured to create solid-gas ice blocks on each KV during the ascent stage of the interceptor. The ice block stays with the KV post-separation and maintains the sensor temperature for the duration of the mission. This reduces the mass/power/volume requirements of each KV.

In a fourth aspect of the invention, a battery on-board the adapter is used to power the KVs during the launch and ascent stages of the interceptor. Provision of a large battery on the adapter allows the batteries on each KV to be smaller.

In a fifth aspect of the invention, a processor on-board the adapter receives the uploaded mission plan and any early updates or additional information and processes the information to distribute to the designated master KV or all KVs during ascent. As a result, the KVs can be powered up later in the ascent stage nearer separation and thus conserve power and reduce heat sink mass.

In a sixth aspect of the invention, a passive sensor is provided having a smaller aperture than the unitary KV. Detection range and resolution are largely dictated by aperture size. Detection range is enhanced by aligning and then temporally averaging multiple frames captured by the sensor. Temporal averaging reduces sensor noise thereby boosting the effective signal-to-noise ratio, which in turn increases detection range. The inertial instrumentation on-board the KV already provides a frame-by-frame alignment of the target image to support correlating images with existing target tracks. This existing tracking data is used to perform the necessary motion compensation to align the image frames for temporal integration. The reduced resolution passive sensor does not retain the capability to discriminate sophisticated decoys but multiple KVs are deployed to allow for overall improved kill performance.

These and other features and advantages of the invention will be apparent to those skilled in the art from the following detailed description of preferred embodiments, taken together with the accompanying drawings, in which:

BRIEF DESCRIPTION OF THE DRAWINGS

FIG. 9 is a table comparing the specific mass budget of a unitary KV, an MKV with the acquisition/discrimination sensor on the CV, and the A-MKV of the present invention;

DETAILED DESCRIPTION OF THE INVENTION

Figure 1:
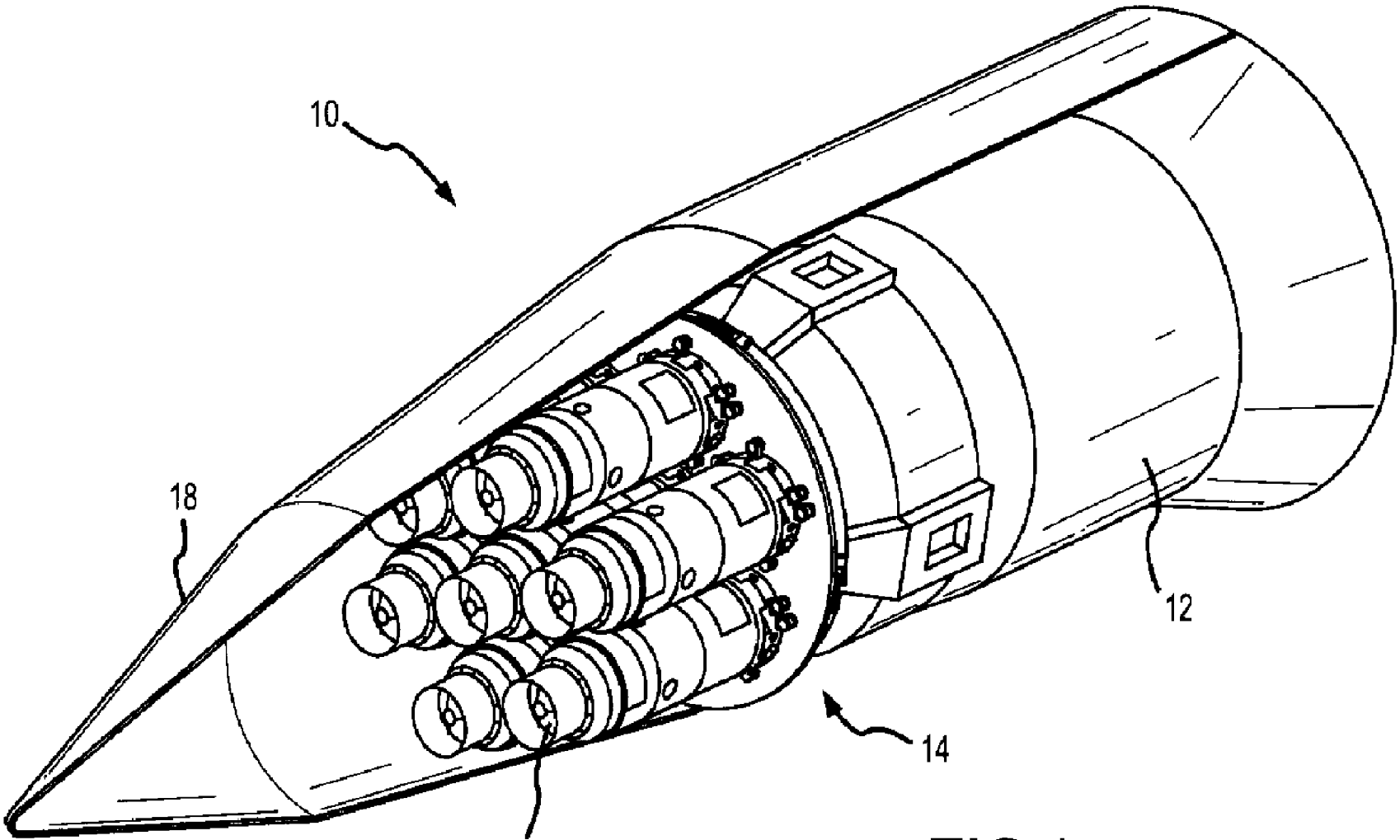
FIG. 1 is a simplified diagram of an MKV interceptor including a booster stage, a carrier vehicle lofted by the booster, and a plurality of autonomous KVs supported by the carrier vehicle for release.

The present invention provides an A-MKV interceptor including multiple kill vehicles with autonomous management capability and kinematic reach to prosecute a large threat extent. Each KV can self-manage its own KV deployment and target engagement for a determined target volume assigned by a designated master KV. At least one KV is master capable of managing the post-separation of all of the KVs without requiring updates to the mission plan post-separation. The autonomous capability and increased kinematic reach provides for a more efficient use of boosters and more effective engagement of the threat. Redundancy provided by multiple autonomous KVs reduces the occurrence of single point failures.

Any interceptor system must perform the endgame functions including acquisition of the target cloud, resolution of the objects, tracking the credible objects, discrimination of the target objects and homing in on the target warhead. The challenge is to provide an interceptor system capable of reliably performing these endgame functions for a particular threat or preferably a range of threats subject to constraints on the mass/volume/power ("MVP") budget for the interceptor and individual KVs. The MVP budget is dictated by physics, economics and the desire to use existing infrastructure and boost stages. The boost capability to launch the interceptor and the propulsion capability to divert KVs to intercept targets is directly proportion to the mass. If boost and propulsion capability were not constrained than multiple unitary KVs could be carried by a very large lift stage, but this is not feasible. Thus, the ongoing challenge is how to allocate the endgame functions throughout the interceptor system and correspondingly how to allocate the MVP budget.

For performance reasons it is desirable to maintain the autonomous management and kinematic reach capabilities of the unitary KV in each KV of an MKV interceptor. "Autonomous" refers to the unitary KV's ability to execute the mission plan without requiring updates to that mission plan or additional information or external queues post-separation. In the context of an MKV autonomous will refer to the MKVs collective ability to manage their deployment to execute the mission plan and their individual ability to prosecute a determined target volume. Such updates or additional information may be helpful but is not required and its absence will not result in complete mission failure but a graceful degradation in performance capability. Autonomous management requires the unitary KV, hence each MKV, have the capability to determine its position and orientation, acquire a determined target volume and remove insertion error, together the "kinematic reach", resolve the assigned target and divert to intercept.

As described above, the unitary KV cannot be simply miniaturized to meet the MVP budget for multiple KVs without a substantial performance penalty. Co-pending U.S. patent application Ser. No. 11/286,760 entitled "Multiple Kill Vehicle (MKV) Interceptor and Method for Intercepting Exo and Endo-Atmospheric Targets", filed on Nov. 23, 2005 centralizes the endgame functions of target acquisition, initial tracking and discrimination on the CV and distributes the functions of terminal homing to each KV. The CV carries a LWIR passive sensor and an E/O active sensor. Each KV is provided with a SWIR or MWIR passive sensor. This approach does not preserve the autonomous management capabilities of the unitary KV, if the CV is lost prior to final handover for terminal homing than the KV cannot complete its assigned mission. Furthermore, the kinematic reach of the KV cloud is limited because the CV must be able to image the entire target space while staying close enough to actively cue each KV.

The present invention provides an A-MKV interceptor in which each KV retains the autonomous management capability and kinematic reach (detection range and divert maneuver) of a single KV interceptor. This is accomplished by reducing the mass of each KV by centralizing functionality such as cryo cooling, space-to-ground communications and pre-separation power and processing on the adapter and reducing the passive sensor mass by providing video processing on each KV capable of providing an effective range of a larger aperture optic. Each KV can self-manage its deployment to execute a determined target volume assigned by a designated master. At least one and preferably all KVs are 'master capable' of managing the deployment of all of the KVs to execute a mission plan. In addition, each KV is not currently required to perform sophisticated discrimination of the unitary KV since more kills are provided per booster. This reduces the sensor and processing requirements, hence mass. At a minimum, each KV must be able to resolve objects in a determined target volume to select and intercept an assigned target. Each KV should also have the capability to identify and reject objects that are not on a ballistic trajectory that presents a threat. Preferably each KV can also discriminate simple decoys and debris.

The reduced discrimination requirements flow from an evolving threat assessment. The current missile defense systems under development such as the unitary KV and the co-pending MKV interceptor are configured to engage an enemy capable of simultaneously launch many missiles with Multiple Independently Targeted Re-entry Vehicles (MIRVs) and highly sophisticated decoys. The sheer number of possible targets and the sophistication of the decoys cannot be countered by a like number of KVs. Consequently the interceptor system requires sophisticated discrimination capability to select the actual targets from the target cloud to reduce the selected targets to a manageable number. The evolving threat assessment is directed towards an enemy having limited capability launch fewer missiles with MIRVs have only rudimentary decoy capability. In this scenario, a missile defense system may be able to intercept all possible targets or at least any object that appears to be a target. This reduces the performance demands, hence mass of the sensor capability. If the threat evolves to again require more advanced discrimination capability the present invention may accommodate those requirements by increasing the sensor capability onboard each KV and reallocating other functionality to accommodate, using advancement in sensor and processing technology to provide the required discrimination without increasing the mass, or by receiving the discrimination information from another source.

The MKV interceptor is a very complex system including much functionality outside the scope of the invention. Consequently, the diagrams and descriptions of the adapter, KVs and methods of acquisition and guidance are limited to the subject matter of the present invention for purposes of clarity and brevity. Other functionality is well known to those skilled in the art of missile defense systems using kinetic energy interceptors.

A-MKV Interceptor and Adapter

Figure 2:
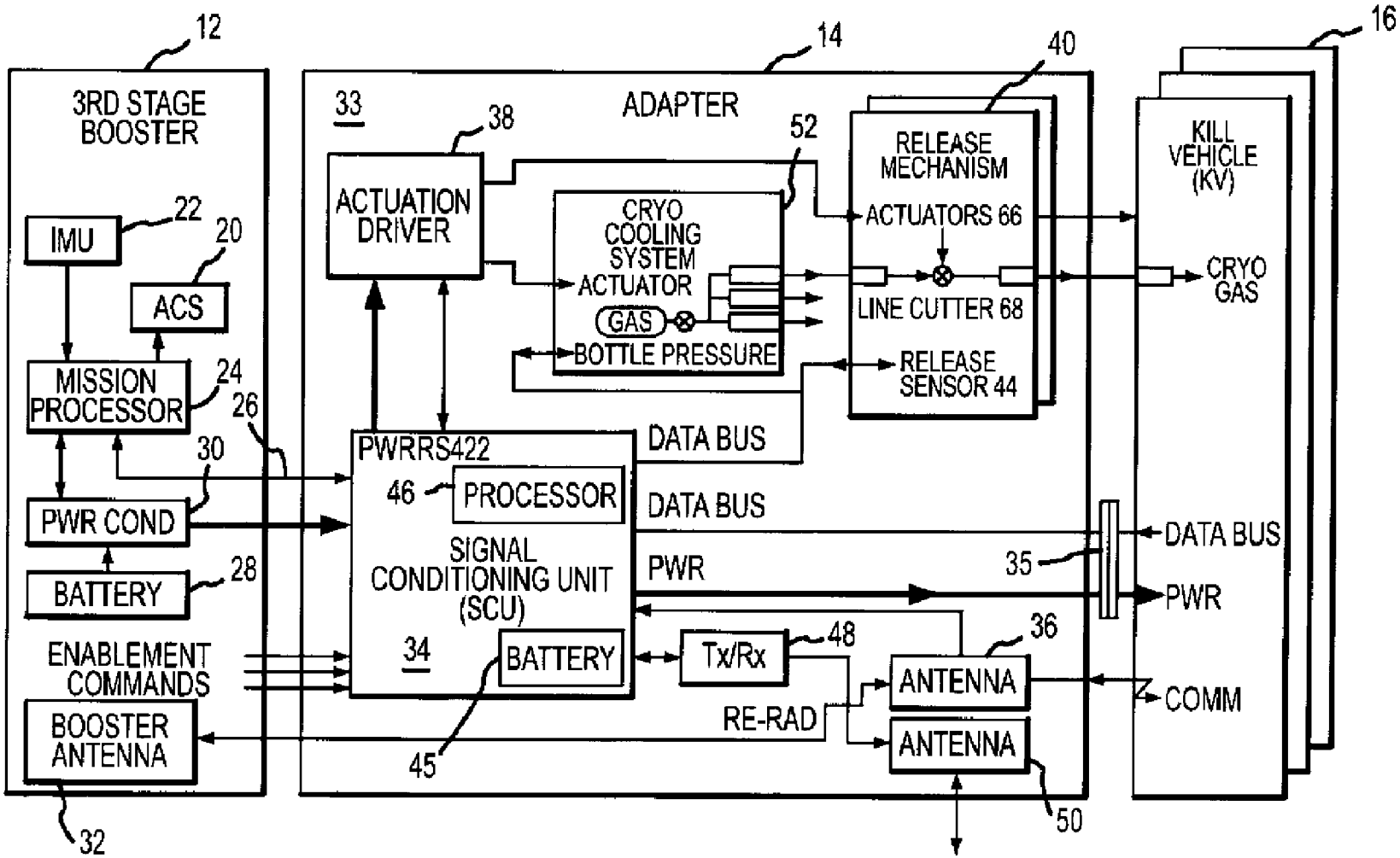
FIG. 2 is a simplified block diagram of the adapter that interfaces with the KVs.

As shown in FIGS. 1 and 2, an exemplary MKV interceptor 10 includes a multi-stage booster 12 of which only the 3rd stage is illustrated in this embodiment, a non-separating adapter 14, a plurality of autonomous KVs 16 initially stored in the carrier vehicle and a shroud 18. The 3rd stage 12 of the booster maneuvers the interceptor onto a ballistic intercept trajectory. Once the interceptor exits the earth's atmosphere the shroud that protects the interceptor from contamination, aerodynamic pressure and heating during launch is jettisoned. Neither the 3rd stage booster 12 nor the adapter 14 include divert capability to remove insertion errors or any sensor capability to acquire or discriminate targets. The 3rd stage booster and adapter are essentially just a bus to launch the KVs on an intercept path and perform certain functions during ascent pre-separation.

The 3rd stage of the interceptor includes an attitude control system 20, Inertial Measurement Unit (IMU) 22 and a mission processor 24 to keep the interceptor oriented in the proper direction as it flies along the ballistic intercept trajectory. The mission processor also communicates with the adapter pre-launch to conduct the Built-In-Test (BIT) and upload an initial mission plan and any updates received during ascent to the adapter via a communication link 26. The initial mission plan is formulated on the ground with inputs from satellites, radar and other sensors and includes minimally a position and heading of a target cloud. The initial plan or updates to the plan may continue to refine position and heading information as well as provide information on the number of targets, discrimination of targets, and priority of targets. A battery 28 and power conditioning unit 30 supply power to mission processor 24 and to the adapter. The booster also provides a number of enablement commands including 1st motion to initiate motion tracking algorithms, a synchronized time clock, safe to power up the KVs to prepare for separation and booster has burned out so safe to separate. The booster also includes an antenna 32 that is coupled to the adapter.

Adapter 14 includes a mechanical support structure 33 that supports the KVs 16 during launch and ascent and deploys them with a mission plan at an insertion point to engage the target cloud. A typical unitary KV CV would include a signal conditioning unit (SCU) 34 to pass data into and out of the KV via umbilical 35 to upload the mission plan and conduct the BIT, an antenna 36 to allow the KV to communicate with the ground during ascent, an actuator driver 38, a release mechanism 40 to physically release the KVs for deployment and a release sensor 44 that detects when umbilical 35 has been broken and the KVs separated.

In the current invention, this and additional functionality that can be performed during ascent pre-separation is centralized in the adapter 14. SCU 34 is provided with a battery 45 that is used to power the KVs during BIT, launch and ascent. This reduces the size of the battery on each KV that is required to complete the mission once deployed. SCU 34 is provided with a processor 46 that processes the initial mission plan and any updates pre-separation to assign specific KVs to determined target volumes of the target cloud. The processor also forwards the most recent mission plan to at least one designated master KV and suitably all of the master capable KVs pre-separation. As a result, at separation each KV has its own mission plan that it can prosecute. This approach allows the KVs to delay power during ascent thereby conserving power and heat sink mass.

In order to continue to update the mission plan post-launch and post-separation and to receive back status information on the KVs and prosecution of the mission, the interceptor must be provided with a bi-directional space-to-ground data link (Tx/Rx). In the standard unitary KV, the one KV is provided with a Tx/Rx and maintains a direct bi-directional link with the ground station. The Tx/Rx has a mass of approximately 4 kg, which is manageable with a single KV but does not scale for multiple KVs to satisfy the MVP budget constraints. Accordingly, the present invention uses a single bi-directional space-to-ground communication node. As shown in FIG. 2, this node may comprise a Tx/Rx 48 and antenna 50 on the adapter or booster third stage. In this case, the adapter would communicate with the designated master KV via the bi-directional space-to-space data link provided by antenna 36. Antenna 50 is connected to the SCU for translation to the ground link via Tx/Rx 48. The KVs communicate with each other via local space-to-space data links that have far less mass. As will be described later, the node may alternately be placed on one of the KVs. The use of a single node provides all of the communication bandwidth necessary but does create a single-point failure. The consequences of such a failure are ameliorated by the autonomous capability of each KV and the KV's ability to prosecute the current mission plan. The loss of the node will not result in complete mission failure but rather a graceful degradation in performance.

Figure 3A:
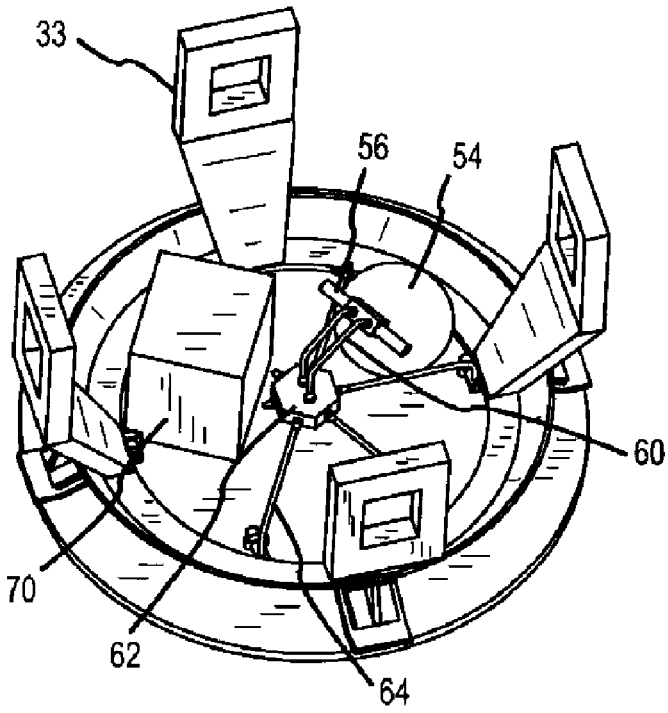
FIGS. 3*a*-3*b* are diagrams of the adapter.
Figure 3B:
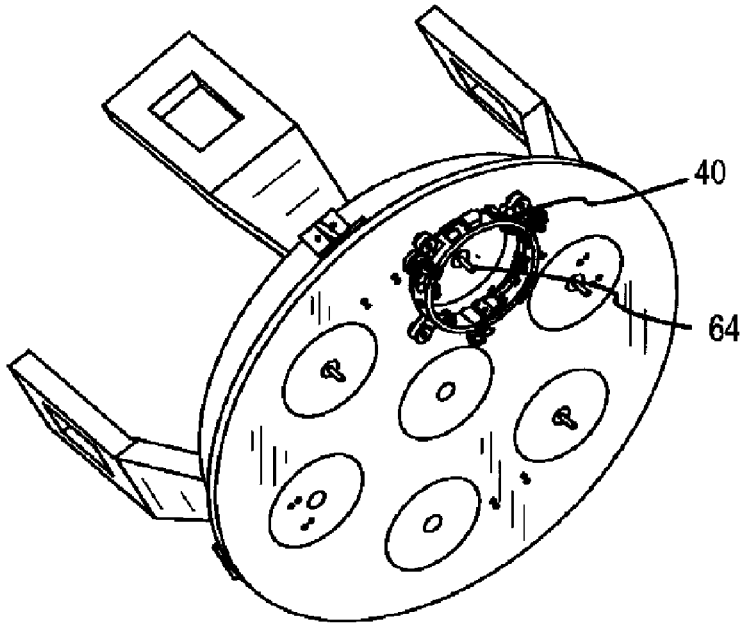
Figure 4:
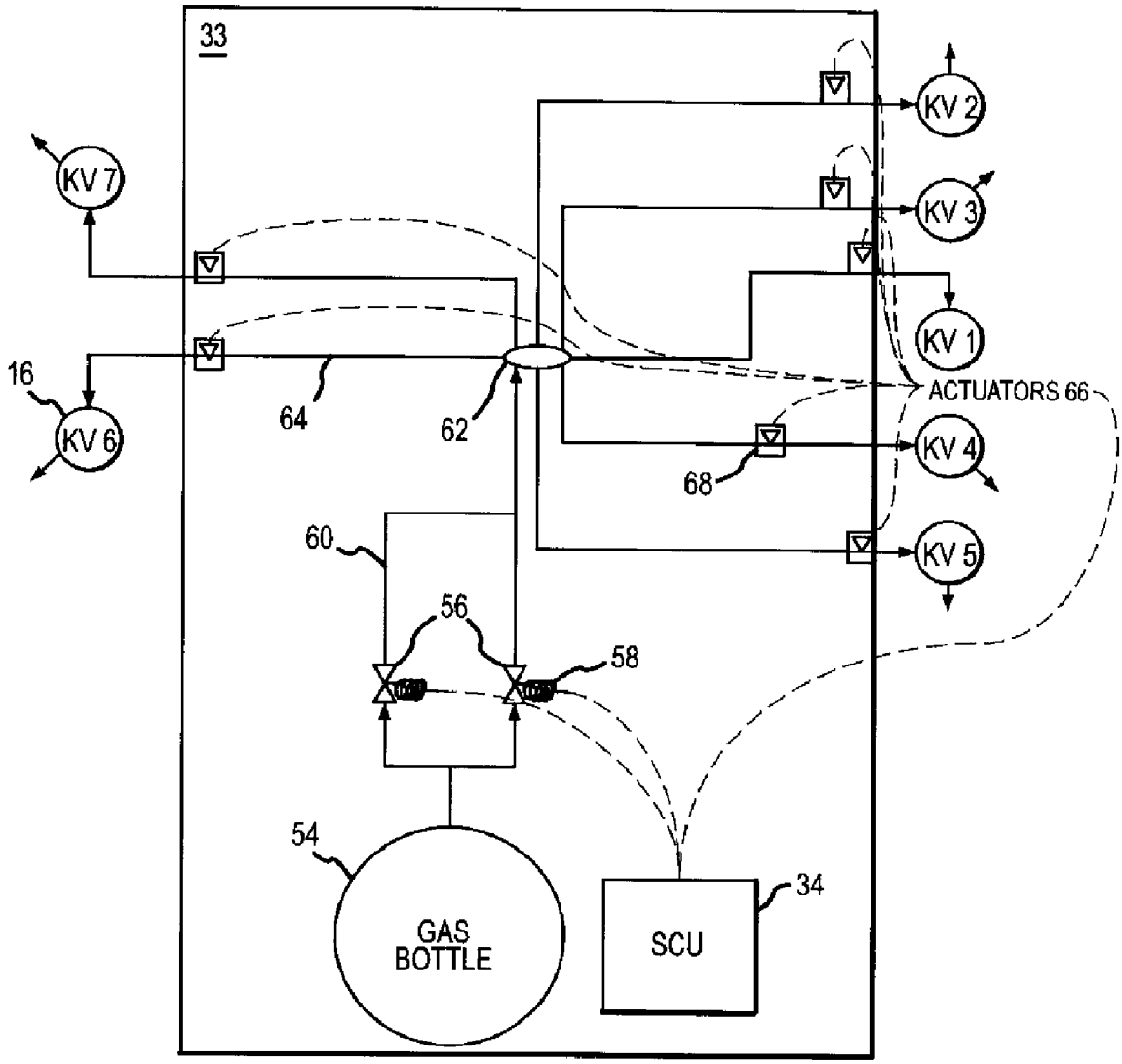
FIG. 4 is a diagram of the adapter cryo system to form ice blocks on the KVs pre-separation.

As shown in FIGS. 2-4, another change is moving the bulk of the passive sensor cryo-cooling system from the KV to the adapter. The cryo-cooling system 52 creates a solid-gas ice block on each KV during ascent that stays with the KV at separation and maintains sensor temperature for the duration of the mission. Cryo-cooling system 52 includes a gas bottle 54, a pair of redundant valves 56 that are controlled by SCU 34 via actuator driver 38 and actuators 58, coolant lines 60 that carry coolant to a gas manifold 62 which in turn distributes coolant via coolant lines 64 that extend through the adapter and release mechanism 40 to the multiple KVs to form the ice block. Once the ice blocks are formed and prior to KV deployment, the SCU via actuator driver 38 and actuators 66 activates line cutters 68 to cut coolant lines 64. As also shown in FIG. 3*a*, the SCU, battery and Tx/Rx are contained in electronics unit 70.

As currently envisioned a generic KV will be built for use in many different interceptor configurations with existing multi-stage or possibly single-stage boosters. In order to accommodate this, the adapter may be specially designed for each type of booster to provide a generic interface to the KVs. Alternately, the 3rd stage could be redesigned to include the adapter functionality but there is a large established base of boosters.

Autonomous KV

Figure 5:
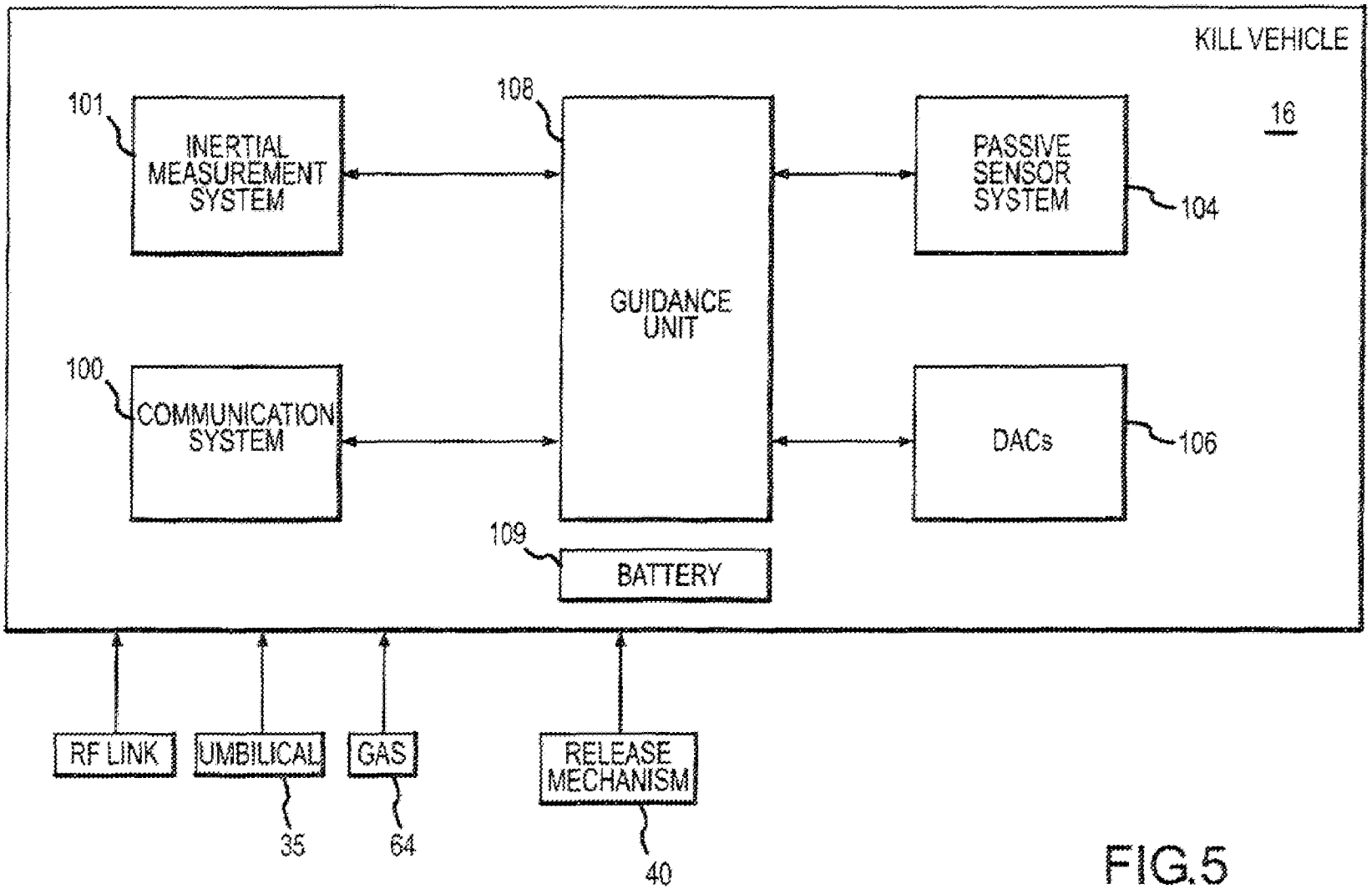
FIG. 5 is a block diagram of the components on the KV.
Figure 6:
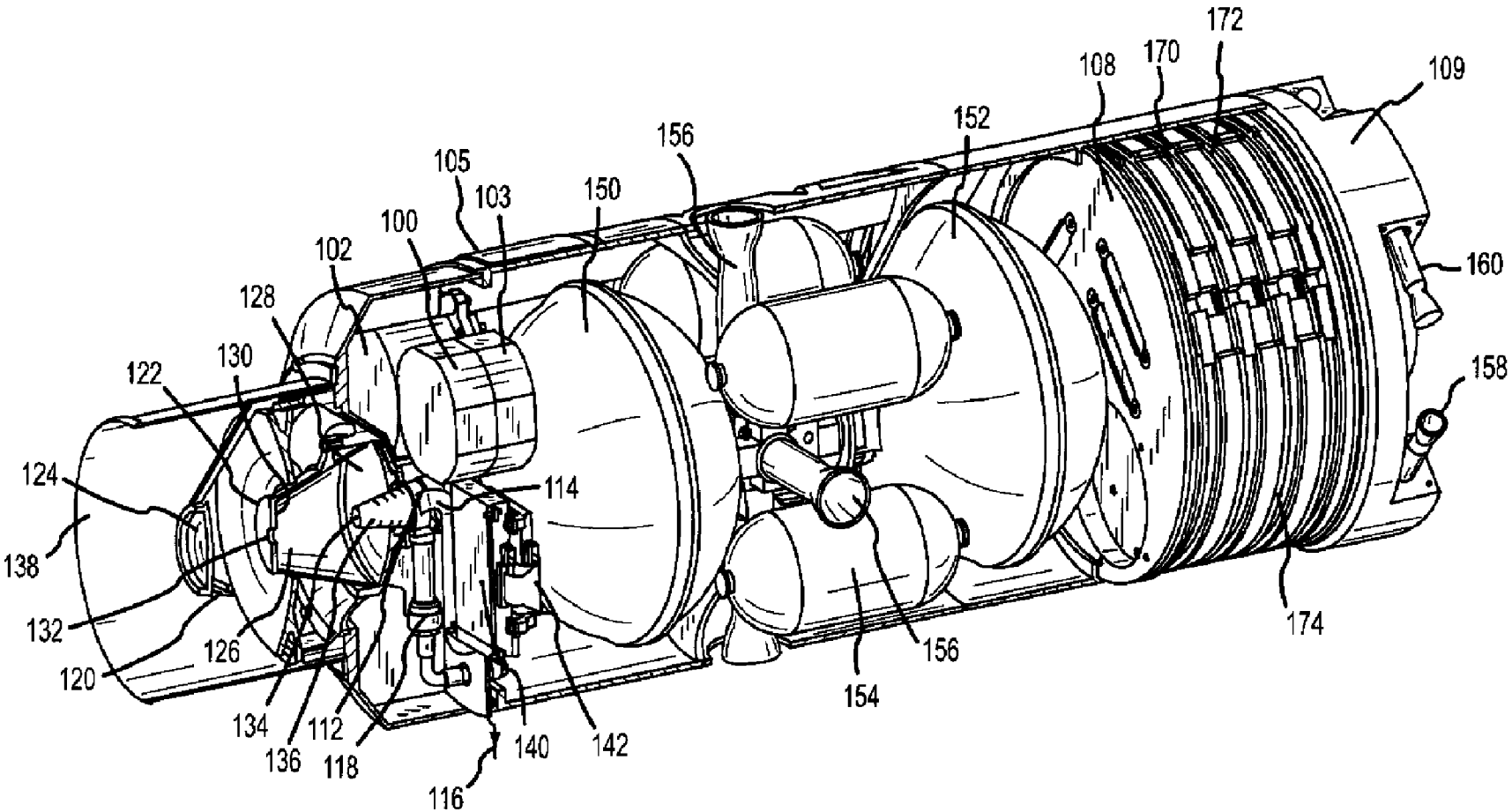
FIG. 6 is a diagram of an embodiment of a KV.

An embodiment of an autonomous KV 16 is illustrated in FIGS. 5-6. Although less than half the mass and less than half volume of the standard unitary KV, the autonomous KV provides the management capability and kinematic reach of the unitary KV to prosecute the mission and discrimination capability to at a minimum resolve and intercept an assigned target and suitably to reject simple decoys. As a result, current multi-stage boosters have enough lift capability to carry approximately seven KVs and prosecute a much larger target space and engage more targets. This provides enormous operational, cost and performance advantages over the unitary KV interceptor and previous MKV concepts.

The autonomous kill vehicle (KV) 16 includes a communication system 100 providing a bi-directional space-to-space data link to communicate with the other KVs, an inertial measurement system 101 including an IMU 102 and an optional GPS 103 (provides improved position localization of the KVs) to determine the KV's position and orientation, a passive sensor system 104 configured to image a determined target volume of a target cloud and provide discrimination to support unambiguous assignment of targets from the mission plan, a divert attitude control system (DACS) 106 with kinematic reach to remove insertion error and prosecute the determined target volume, and a guidance unit 108 configured to manage post-separation KV deployment and target engagement as a designated master KV and to self-manage its own KV deployment and target engagement for the determined target volume assigned by the designated master KV. The KV also includes a battery 109 to power the KV. As currently envisioned, each KV's guidance unit is 'master capable' of managing the deployment of the KV cloud providing redundancy for successful prosecution of the mission. However, the minimum requirement is that at least one KV be master capable.

Figure 7A:
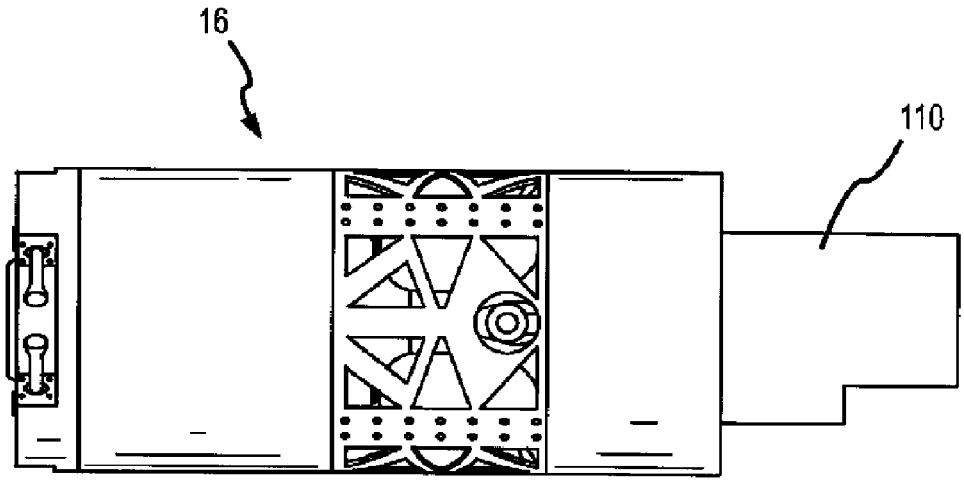
FIGS. 7*a* and 7*b* are alternate embodiments of a KV modified to include the space-to-ground data link.
Figure 7B:
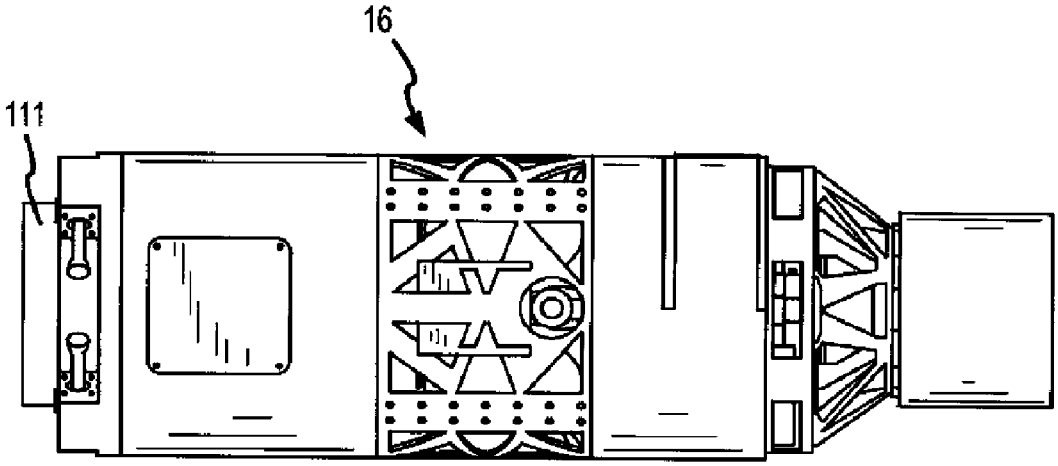

As also currently envisioned, communication system 100 only provides local space-to-space communication with the other KVs and the adapter via patch antenna 105. However, as mentioned earlier the space-to-ground communication node could be placed on one of the KVs. As shown in FIG. 7*a*, passive sensor system 104 has been removed and replaced with a bi-directional space-to-ground data link 110. The KV has approximately the same volume and mass as the autonomous KV but no sensor capability. This KV could be used as the designated master to manage the KV cloud and not intercept a target. The KV can fly to the target cloud based on sensor information conveyed from the other KVs. As shown in FIG. 7*b*, a bi-directional space-to-ground data link 111 is added to the back of the carrier vehicle. The mass and volume dedicated to the propulsion system can be reduced to compensate for the additional mass of the communication node. This KV could then be used to intercept the target with the least divert requirement.

Passive Sensor System

Passive sensor system 104 includes a one or two color focal plane array 112 that provides a passive LWIR sensor. A one color FPA is adequate to resolve objects and intercept an assigned target. The second color allows the KV to eliminate simple decoys as non-credible. A second FPA could be included to further improve discrimination. Specific methods for passive LWIR acquisition and discrimination of real targets from a target cloud are known in the art and beyond the scope of the present invention. However, an aspect of the invention is to process the sensed images to boost the effective signal-to noise ratio (see FIG. 8). A smaller aperture for the FPA can provide the same kinematic reach to acquire targets as the larger aperture on the unitary KV.

FPA 112 is positioned in front of a reservoir 114 in which the solid-gas ice block is formed during ascent. Cryo coolant is delivered from the adapter through a cryo line 116 to a heat exchanger 118 that forms the ice block. Cryo-cooling is required for useful infra-red sensor performance in this application. The weight of the cryo-system on the KV is reduced to approximately 400 grams from a weight of 4.5 Kg. Centralizing the gas bottle and other components on the adapter saves considerable mass.

The optical system for imaging the target cloud onto FPA 112 comprises a first telescope structure 120 that supports a primary mirror 122, e.g. a 6" diameter mirror, and a secondary mirror 124; a second telescope structure 126 inside the first that supports a tertiary mirror 128 and a quaternary mirror 130; a hole 132 in the quaternary mirror 130 forming a 'field stop' on the front side of the quaternary mirror; a window 134 and cold baffles 136. Primary mirror 122 has an annular shape through which the second telescope structure extends and tertiary mirror 128 has an annular shape through which the cold baffles extend. Optics cover 138 covers the optical system.

Light enters from left-to-right and strikes primary mirror 122 where it is reflected back to the left and concentrated onto secondary mirror 124, which in turn reflects the light back to right onto the field stop 132. The field stop and baffles serve to block out all extraneous light that is not originating from where the sensor is pointed, e.g. the target cloud. Light passing through the field stop expands to tertiary mirror 128 where it is reflected back to the left and concentrated onto quaternary mirror 130 around the field stop, which in turn reflects the light to the right further concentrating it onto window 134. The light proceeds through cold baffles 136 onto FPA 112.

The FPA is coupled to the sensor electronics 140 and to a digital video cable 142 that carries video sensor data back to the guidance unit. Sensor electronics 140 provides clock and bias signals to the FPA and converts the analog video from the FPA to a digital video signal used by the guidance unit.

DACS

The propulsion system or DACs 106 provides for both attitude control and divert maneuver capability to remove insertion error to prosecute at least a determined target volume of the target cloud and suitably any part of the cloud if needed. The divert system is a bi-propellant system that includes fuel and oxidizer tanks 150 and 152, respectively. Four helium tanks 154 are used to push the fuel/oxidizer out of the tanks to the divert thrusters 156 and to fire the fine attitude thrusters 158. The divert thrusters provide the divert maneuver capability to remove insertion error and fast divert to impact the target. Attitude thrusters include high-level thrusters 160 that are used to maintain attitude when divert thrusters are firing. The fine attitude thrusters 158 are used to make fine corrections to attitude when the divert thrusters are not firing. Although the autonomous KV has much less mass then the unitary KV it maintains the same divert capability by adjusting the mass of fuel and oxidizer for the KV mass. Thus an 7-8 MKV interceptor can address a much larger target cloud.

Guidance Unit

Guidance unit 108 includes first and second cards 170 and 172 separated by heat sinks 174. The first card includes a video processor and a general processor. The second card includes power conditioning and the high current drivers for squibs and propulsion control. The general processor provides track processing from the IMU measurements and sensor video, communications and control of the DACs. The general processor also provides the capability to act as the designated master to manage KV deployment and to self-manage a KV to prosecute a determined target volume. The general processor may handle the BIT for each KV internally and report a single global health to the ground station to maintain the same interface as the unitary KV.

The video processor receives the digital video from the sensor electronics and corrects the video by applying unique offset and scale-factor corrections for each pixel of video. The video processor further removes signals from non-operable pixels and then thresholds the remaining operable pixels to identify potential objects to be tracked. The video processor then localizes each threshold crossing to identify unique potential objects. The video processor further passes the location and radiometric intensity of each potential object to the general processor.

The general processor then compares the potential objects with the existing tracks on record and updates the existing track information for the persistent objects. The general processor then computes the features on the information in each persistent object's track file to determine which object(s) are potential threats. The general processor then estimates the KV trajectory that will enable the KV to intercept the desired object and fires the divert thrusters to alter its trajectory to intercept the desired object.

Figure 8:
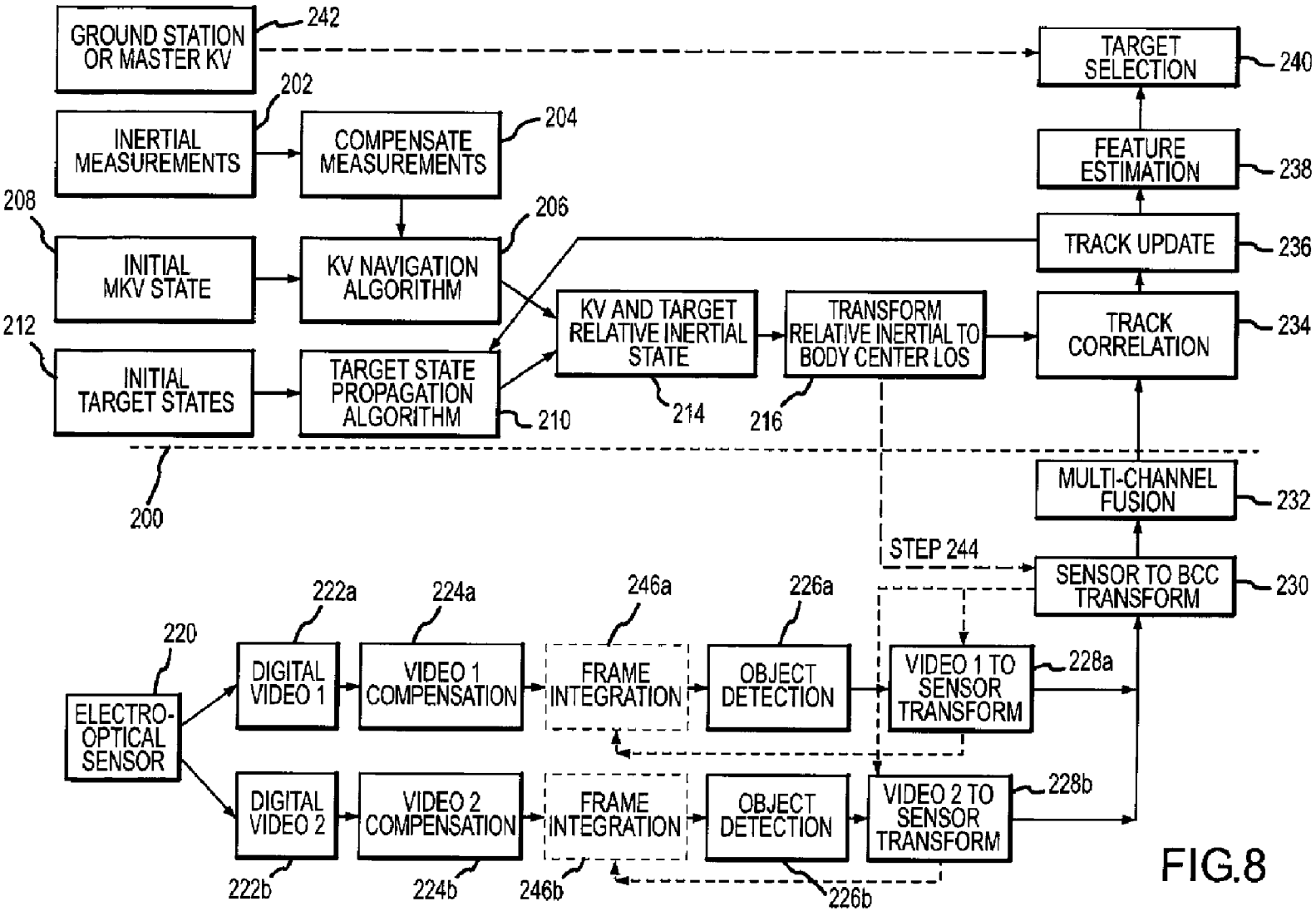
FIG. 8 is a block diagram of a video processing system using existing tracking information to motion compensate and temporally average sensed images.

FIG. 8 illustrates a standard video tracking algorithm executed by the video and general processor to detect and track objects modified in accordance with the present invention to boost the effective SNR of the sensed video, hence increase the effective detection range or 'reach' of the sensor. A key step is 'object detection' which is needed to acquire, resolve, discriminate, prioritize and ultimately track objects. Because the aperture size is less than that of the unitary KV fewer photons are collected and the detection range is reduced. The effective aperture size can be increased by temporally averaging video frames to reduce sensor noise and thus increase SNR. To do this effectively, the frames must be compensated for the relative motion of the sensor and object from frame-to-frame. At the closing speeds of two objects (target & KV) on ballistic trajectories towards each other this would ordinarily be a daunting challenge. However, in order to 'track' the objects the guidance system must generate the required motion compensation data for each acquired frame in order to correlate new observations with existing persistent object tracks. This data is thus tapped off of the standard video tracking algorithm, transformed from body to sensor and than to video coordinates. The modifications to the standard algorithm are depicted as dashed lines. This simple x,y translation (targets at great distance appear as point source so no rotation/scaling required) is than fed to a frame integrator. As a result, the SNR of the frames is improved significantly, approximately 2-3×, without any additional hardware on the KV and minimal processing to shift and add consecutive frames.

The baseline video tracking algorithm includes a body tracking channel (above line 200) and a sensor channel (below line 200). The general processor processes the data and algorithms for the body tracking channel while the video processor processes the sensor data and algorithms for the sensor channel.

The body tracking channel receives inertial measurements 202 from the IMU, compensates them for temperature, humidity, non-orthogonalities etc. (step 204) and inputs them to a KV navigation algorithm (step 206) that uses the initial KV state 208 (position & orientation and time at launch) and the updated IMU measurements to integrate the trajectory of the KV to give its current position and orientation. In parallel, a target state propagation algorithm (step 210) uses a Kalman filter, for example, to predict the target path given the initial target states 212 uploaded to the interceptor and subsequent track updates 236. The outputs of the KV Navigation and Target state propagation algorithms provide a relative inertial state of the KV and target 214. This relative inertial state is then transformed (step 216) to the body center line of sight (LOS) coordinate system. This transform translates the 'historical' frames so that they coincide with the current frame so the same object should appear in the same place allowing it to be tracked or, if a new object, allowing a new track to be initiated.

As shown, the sensor channel includes a two-color electro-optical sensor 220 that generates two channels of digital video 222*a* and 222*b*. Each channel is then compensated for gain, offset, etc. (steps 224*a* and 224*b*). In the baseline algorithm, object detection (steps 226*a* and 226*b*) is performed on each video frame to detect bright spots in the frame and try to determine the number of objects, size of objects, and position of each object in the frame. Each frame is tagged with the object information. The frame is then transformed from its video coordinate space to sensor coordinates space (steps 228*a* and 228*b*) and then to the body center coordinate space (step 230). The information from the two (or more) channels is fused (step 232) and passed to the tracker for correlation with existing object tracks. The tracker uses the object detection information for the current frame and the motion compensated historical frames to execute a tracking algorithm (step 234) and update the one or more object tracks 236. The general processor then executes a target discrimination algorithm to extract features for each of the tracked objects (step 238) and selects the most likely or highest priority targets (step 240). In an aspect of the invention, information that may augment or override discrimination decisions and target selection can be provided from the ground station via the space-to-ground communication node or from the master KV (step 242). For example, the ground station may have additional and better information from other sensors. The master KV may have information from other of the deployed KVs and may synthesize the information to coordinate target selection and priority for all of the KVs. The target selection and prioritization is then passed to the guidance unit to prosecute the selected target.

In accordance with the invention, the one or more (typically 3-30 frames) motion compensated historical frames (for each color) at step 216 are transferred from the body center coordinate system back to the video coordinate system (step 244) by passing back through the transforms in step 230 and steps 228*a* and 228*b*. The current and historical frames are integrated (steps 246*a* and 246*b*) to improve the SNR of the frame and passed to the object detection algorithm. Frame integration may be a sliding window that outputs an integrated frame for each video frame or it may output an integrated frame for each N video frames depending on overall system design. Improving SNR greatly enhances the object detection algorithms ability to reliably detect objects thereby by increasing the effective acquisition reach of the sensor and KV.

Mass Budget

A mass budget comparing the autonomous KV shown in FIG. 5 and the interceptor shown in FIG. 1 ("A-MKV") in accordance with the invention to the unitary KV of a standard unitary KV ("UKV") and to the alternate MKV interceptor ("CV-KV") of the co-pending application is illustrated in table 300 of FIG. 9. The top portion of the table provides a comparison of a single KV and the bottom portion provides a comparison of the total interceptor payload including the CV or adapter and one or more KVs (excluding the booster stages).

In developing the A-MKV the mass of the UKV has been reduced from 66.23 kg to 29.16 kg while maintaining comparable autonomous capability and kinematic reach and preserving discrimination capability of simple decoys. The A-MKV has eliminated 4 kg for the cryo gas supply by centralizing that function on the adapter, 3.4 kg in the passive EO sensor (1 FPA instead of 3, 6" aperture instead of 8"), 3 kg in the guidance unit (fewer FPA to process and delayed turn on during ascent means less heat loading), 0.40 kg in the battery (using the adapter batter during ascent), and 2 kg in communication (substituting a local space to space communication system for the space to ground system). Additional mass savings have been achieved in harnesses, the IMU, telemetry and ballast. The addition of GPS capability adds 0.23 kg. The largest mass savings comes from cascading these changes through the propulsion system. As shown in the table, the UKV propulsion system is 33.46 kg whereas the A-MKV propulsion system is only 16.05 kg or about half the mass. With the notable exception of the cryo gas supply, the mass as a percentage of the total KV weight is roughly the same for the A-MKV and the UKV. The mass of the total interceptor for the A-MKV (303.82 kg) is considerably larger than the UKV (96.73) because the A-MKV interceptor launches and deploys seven KVs in this example. As a result, the prosecutable volume is approximately seven times that of the UKV. Furthermore, although the interceptor mass is significantly greater it is within the 350 kg capacity of the existing booster stage.

In comparing the A-MKV to the CV-KV, which centralizes acquisition and discrimination sensor capability on the CV, it is noted that the CV-KV is only 11.65 kg. However, a performance penalty is paid in that the CV-KV cannot prosecute the mission plan autonomously post-separation and has limited kinematic reach. Although the booster can launch twice as many KVs the prosecutable volume is much less than the A-KV interceptor due to the limited kinematic reach of each KV. In addition the mass savings found in the individual CV-KV is offset by the large mass associated with the CV sensor and target designator and the required propulsion to mitigate insertion error.

Compatibility with Existing Infra-Structure and Built-in Test (BIT)

It might seem that such a change in the interceptor architecture would in validate the existing launch silo and in-flight communication architecture and interfaces designed for the unitary KV. However, the proposed MKV interceptor with multiple autonomous KVs is able to provide full compatibility. The infrastructure can be updated to provide additional capabilities supported by the MKV interceptor design.

In the silo, the launch interface equipment is configured to talk to a single unitary KV on the interceptor. To accommodate this, the adapter is configured to talk to the launch interface equipment and either a designated master KV that talks to the other KVs or all of the KVs during the pre-launch and ascent phases. Post-separation the designated master talks to the ground via the space-to-ground node located either on the adapter or the master KV. The single master coordinates all ground communication, fusing data received from the different KVs, and assigning KVs to determined target volumes and specific targets. Multiple to all of the KVs can be configured to be master capable should the initially designated KV be lost. If the space communication node is located on the adapter, the alternate master KVs retain the same capability. If the space communications node is located on the initially designated KV, than the capability to receive updates to the mission plan is lost but the master KV can still deploy all the KVs to execute the existing mission plan. The single point failure associated with the space communications node can be ameliorated by providing a redundant space communications node on other KVs. However, as described above in FIGS. 7*a*-7*b*, in current configurations the inclusion of the space communications node either eliminates the sensor system, reduces the kinematic reach of the KV or increases the mass of the communication KV.

To maintain compatibility with the launch interface equipment, an embodiment of the MKV interceptor does not include all of the KVs in the pre-launch BIT. Typically, this test assures that all elements of the systems are in working order prior to launch. Limiting the test to a subset of the KVs is required largely by limitations in the external power supplied to the booster during this stage of the pre-launch sequence. The effect of testing only a subset of KVs is minimal. First, all of the system-level single point failures are still checked. The elements that are not checked are inherently redundant since they are on multiple KVs. Failure in these elements produces diminished system capability but not complete failure. Furthermore, all of the KVs can be tested by rotating the KVs in the subset on a regular schedule in addition to the normal pre-launch BIT. Alternately, the adapter processor can be configured to execute a BIT on each KV and report out a global health of all KVs.

MKV Interceptor Mission Sequence

An exemplary embodiment of an MKV interceptor mission sequence for intercepting exo-atmospheric targets using the MKV interceptor described above is illustrated in FIGS. 10 through 13.

Figure 10:
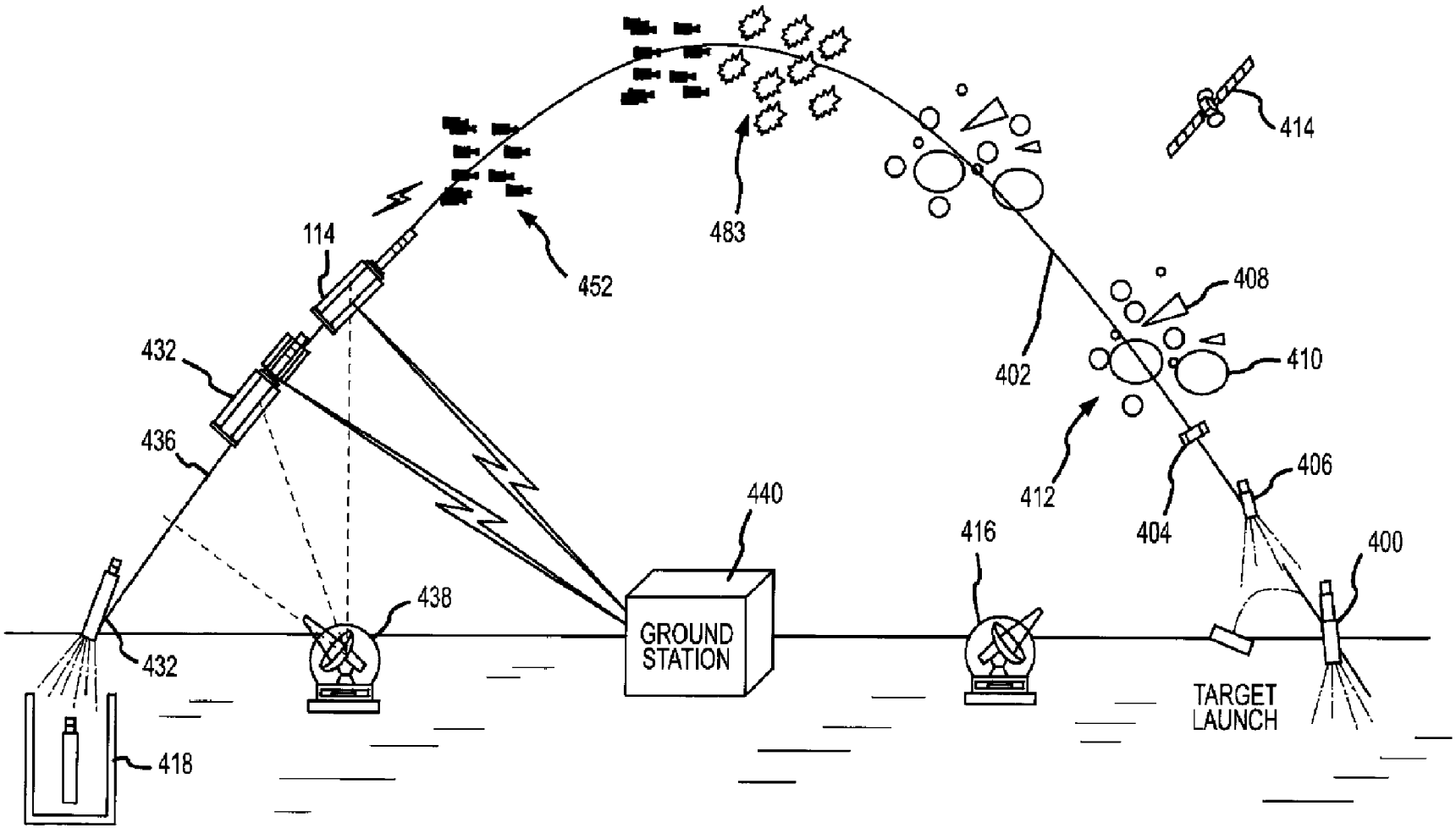
FIGS. 10 and 11 are a diagram and flowchart of an A-MKV interceptor mission sequence.
Figure 11:
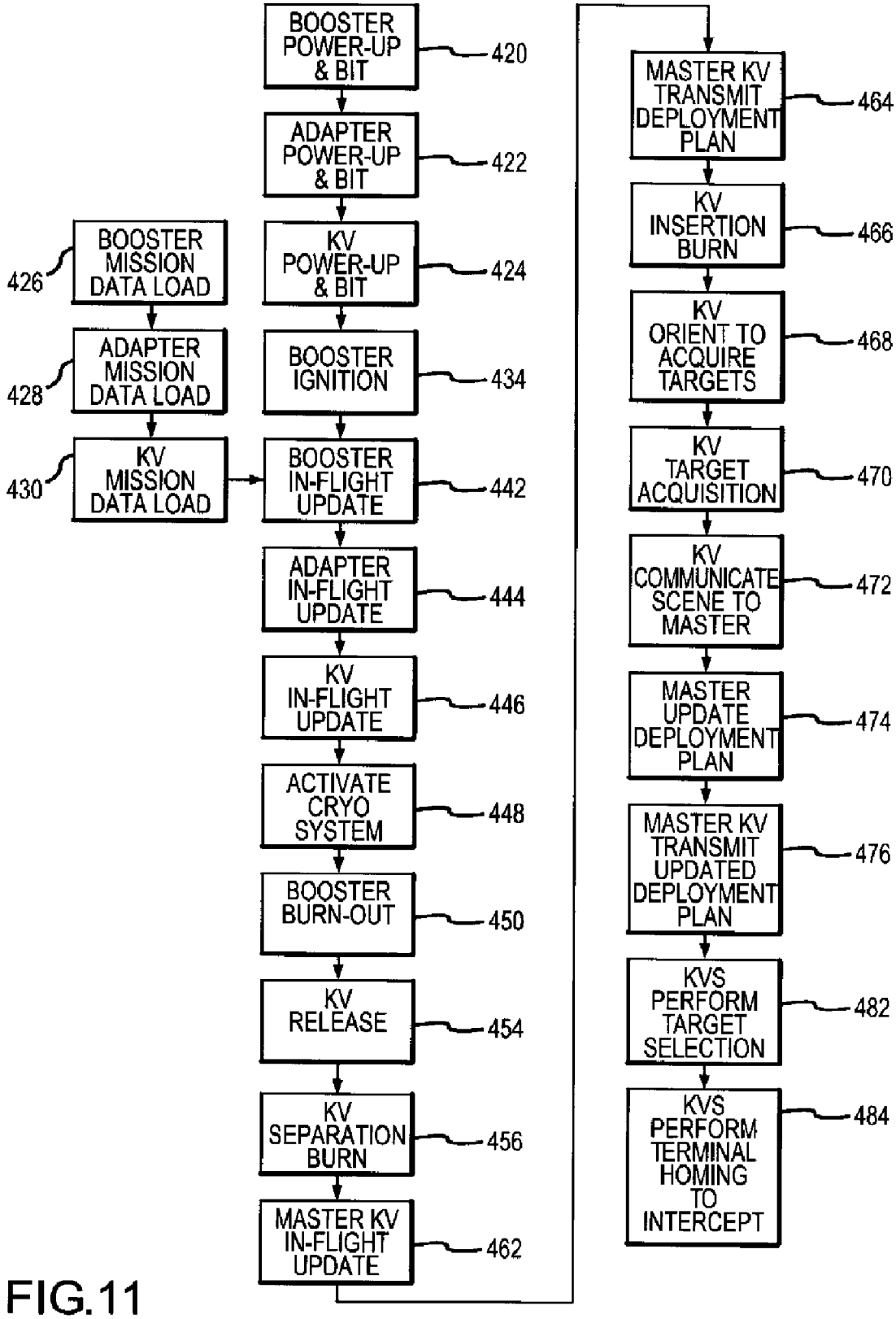

As shown in FIG. 10, a hostile missile 400 is launched on a ballistic trajectory 402 towards a friendly target. The MIRV warhead 404 separates from the boost stage 406 and the multiple re-entry vehicles RVs (targets) 408 and unsophisticated decoys, chaff, etc. 410 for a target cloud 412 that generally follows the ballistic trajectory. The targets may deviate from this trajectory either unintentionally upon re-entry into the atmosphere or intentionally to defeat a missile defense system.

A missile defense system includes a number of external systems e.g. satellites 414, radar installations 416, other sensor platforms, etc that detect missile launch, assess the threat, and determine external target cues (ballistic trajectory, time to intercept, number of RVs, etc.). The defense system engages a silo (or silos) 418 to initiate power up and BIT of the interceptor prior to launch. The silo's launch interface equipment powers up and performs the BIT for the booster, adapter and KVs in sequence (steps 420, 422, 424) while in parallel loading the booster, adapter and KV mission data (steps 426, 428, 430) as each element passes BIT for an interceptor 432. The KV mission data load includes the assignments made by the adapter processor for each KV to prosecute a determined target volume and, for at least one master KV, the entire mission plan. The silo ignites the $1^{st}$ stage booster (step 434) to launch interceptor 432 along an initial intercept track 436 based on those external target cues. The interceptor may be suitably tracked by a ground based radar installation 438 and engages it's divert and ACS systems to put the interceptor on the initial intercept track. Once aloft, the interceptor drops the $1^{st}$ and then the $2^{nd}$ booster stages and jettisons the shroud.

Ground station 440 continues to gather information from satellites 414, radar installations 416 and 438, and other sensor platforms to get up to date information on the position of the target cloud, target discrimination information etc. and uplink updated mission plans to the interceptor for the booster, adapter and KVs (steps 442, 444, 446). During ascent the adapter's cryo-cooling system is activated to form the solid-gas ice blocks for each of the KVs (step 448). Once the $3^{rd}$ stage booster burn-out is complete (step 450), the adapter releases the KVs 452 (step 454), which perform a separation burn (step 456) to deploy themselves safely away from the adapter and each other.

Once deployed, ground station 440 transmits another update via the space communications node on the adapter 458 to at the master KV 460 (step 462). If the currently designated master KV is not recognized or its existence verified, the next master capable KV is so designated. Master KV 460 formulates and transmits a deployment plan to each of the other KVs 452 (step 464). An important aspect of the "autonomous" capability of each KV and the KV cloud is the formulation of the deployment plan to most effectively prosecute the mission plan. The deployment of the KV cloud and individual KVs is not controlled by the ground station or the adapter but by the KVs themselves. The uploaded mission plan is only required to provide sufficient information for the KVs to acquire the target cloud. The master KV then decides how to optimally deploy the KVs to kill the most and the most significant members of the cloud.

This local network centric management enhances the KVs ability to adapt to changing circumstances and new information and to optimize prosecution of the mission. Each KV's deployment plan may be simply the coordinates of a determined target volume or it may include specific target information within the determined target volume depending on the information uplinked from the ground and available to the master and the discrimination capability of the KVs themselves.

Figure 12:
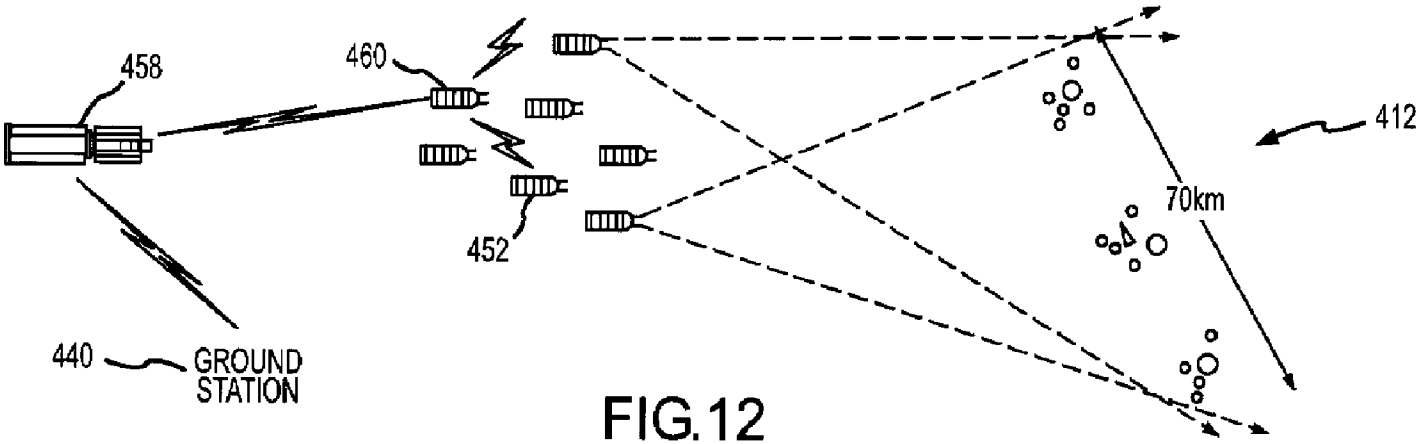
FIG. 12 is a diagram illustrating the kinematic reach of the KV cloud and individual KVs.

As depicted in FIG. 12, each KV has the kinematic reach to prosecute any portion of the target cloud 412. This provides the master KV with great flexibility to assign more KVs to a portion of the cloud with more or higher priority targets or to retask KVs as additional information is gathered. Furthermore, the master KV can synthesize sensor information from the individual KVs to improve target localization and particularly target discrimination. Although each KV may have less discrimination capability than a large unitary KV the KV cloud may have better capabilities. This type of "cooperative engagement" may be very powerful in effectively deploying the KVs to prosecute the threat.

Figure 13:
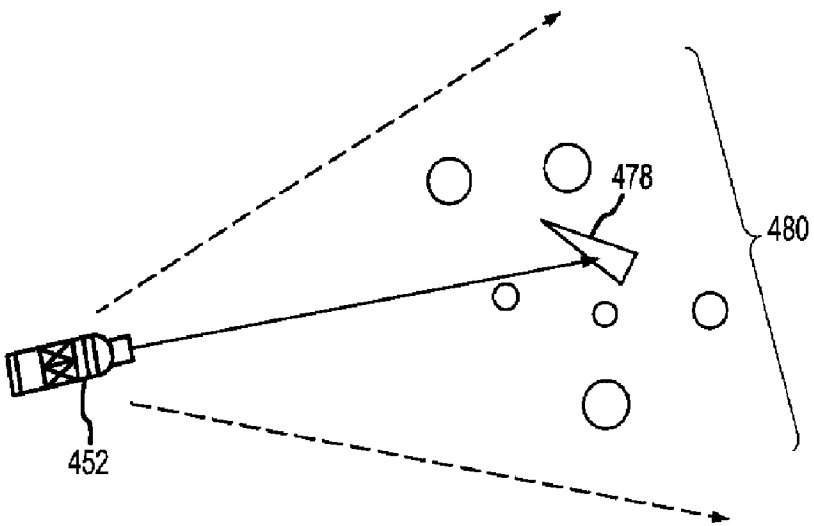
FIG. 13 is a diagram illustrating a single KV that has diverted to engage its determined target volume of the target cloud.

Once the KV deployment plan is received, each KV performs an insertion burn (step 466) to mitigate any insertion error of the interceptor. The KVs orient themselves to acquire their determined target volumes (step 468) and gathers data to acquire the assigned target (step 470). The KVs communicate back track and discrimination information on their respective target volumes to the master KV (step 472), which updates the deployment plan (step 474) and transmits it to the KVs (step 476). This process can be repeated one or more times as time allows. If the master KV is lost, a next designated master KV takes its place. If contact with any master is lost, the KVs execute their last updated deployment plan. At this point, each KV selects its target 478 from its determined target volume 480 (step 482) and performs terminal homing to intercept 483 (step 484) as shown in FIG. 13. The specific target may be assigned by the master so that the slave KV must only resolve the objects and hit the one it is assigned. Conversely, the KV may be instructed to intercept the best target in the volume, in which case the KV must perform some discrimination. If the target localization information provided by the ground station and/or synthesized by the master KV is good enough, the determined target volume may be small enough that only the target is included.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A multiple kill vehicle (MKV) interceptor for intercepting targets, comprising:

a booster stage configured to provide boost and attitude control to launch the interceptor on a ballistic trajectory;

a plurality of autonomous kill vehicles (KVs); and an adapter, including, a support structure configured to support the KVs during launch and deploy the KVs with a mission plan to engage a target cloud;

a bi-directional space-to-ground data link to receive updates on the mission plan and transmit mission information on KV deployment and target engagement; and a bi-directional space-to-space data link to transmit the mission plan to at least one designated master KV and receive said mission information, wherein each said autonomous KV comprises, a bi-directional space-to-space data link to communicate with the other KVs and the adapter, an inertial measurement system configured to determine the KV's position and orientation, a passive sensor system configured to image a determined target volume of the target cloud and provide discrimination to support unambiguous assignment of targets from the mission plan, a divert attitude control system (DACS) with a kinematic reach to remove insertion error and prosecute the determined target volume; and a guidance unit configured to manage post-separation KV deployment and target engagement as the designated master KV and to self-manage its own KV deployment and target engagement for the determined target volume assigned by the designated master KV.

2. The MKV interceptor of claim 1, wherein said adapter does not include propulsion and sense capability.

3. The MKV interceptor of claim 1, wherein said adapter supports a cryo cooling system configured to form an ice block on each said KV during ascent that remains with the KV post-separation to cool the passive sensor on the KV.

4. The MKV interceptor of claim 1, wherein said adapter supports a signal conditioning unit that supplies power to the KVs during ascent.

5. The MKV interceptor of claim 1, wherein said adapter supports a processor that receives and processes the mission plan for engaging the target cloud and assigns a designated target volume of the target cloud to each KV, said processor passing the full mission plan on to at least one designated master KV pre-separation.

6. The MKV interceptor of claim 5, wherein the processor performs a built-in test (BIT) for each KV and reports back a single global health.

7. The MKV interceptor of claim 1, wherein said inertial measurement system provides frame-by-frame tracking data of a target image, each KV further comprising:

a video processor that uses the existing frame-by-frame tracking data to motion compensate and temporally average multiple target images captured by the passive sensor system to generate a noise-reduced target image and to detect objects in said noise-reduced target image; and a tracker that uses the frame-by-frame tracking data to correlate noise-reduced target images with existing target tracks.

8. The MKV interceptor of claim 1, wherein post-separation said designated master KV receives any updates to the mission plan via the adapter, updates and transmits KV deployment to the other KVs, which perform an insertion burn to mitigate insertion error and acquire the determined target volume.

9. The MKV interceptor of claim 8, wherein said designated master KV receives data on the determined target volumes from the deployed KVs, updates and transmits KV deployment back to the other KVs, which then self-manage terminal engagement of the determined target volumes.

10. A multiple kill vehicle (MKV) interceptor for intercepting targets, comprising:

a booster stage configured to provide boost and attitude control to launch the interceptor on a ballistic trajectory;

a plurality of autonomous kill vehicles (KVs); and an adapter configured to support the KVs during launch and deploy the KVs with a mission plan to engage a target cloud;

wherein each said autonomous KV comprises, a bi-directional space-to-space data link to communicate with other KVs, an inertial measurement subsystem configured to determine the KV's position and orientation, a passive sensor subsystem configured to image a determine target volume of the target cloud and provide discrimination to support unambiguous assignment of targets from the mission plan, a divert attitude control system (DACS) with a kinematic reach to remove insertion error and prosecute the determined target volume, and a guidance unit capable of self-managing its own KV deployment and target engagement for the determined target volume assigned by a designated master KV;

wherein at least one said KV's guidance unit being configured to manage post-separation KV deployment and target engagement as the designated master KV to execute a mission plan to intercept the target cloud; and a bi-directional space-to-ground data link on either the adapter or one said designated master KV to receive updates on the mission plan and transmit mission information on KV deployment and target engagement.

11. The MKV interceptor of claim 10, wherein said adapter supports, a cryo cooling system configured to form an ice block on each said KV during ascent that remains with the KV post-separation to cool the passive sensor on the KV;

a signal conditioning unit that supplies power to the KVs during ascent; and a processor that receives and processes the mission plan for engaging the target cloud and assigns a designated target volume of the target cloud to each KV, said processor passing the full mission plan on to at least one designated master KV pre-separation.

12. The MKV interceptor of claim 10, wherein a plurality of said KV's guidance units are configured to manage post-separation KV deployment and target engagement as the designated master KV.

13. The MKV interceptor of claim 10, wherein said bi-directional space-to-ground link is on the initially designated master KV.

14. A multiple kill vehicle (MKV) interceptor for intercepting targets, comprising:

a booster stage configured to provide boost and attitude control to launch the interceptor on a ballistic trajectory;

a plurality of autonomous kill vehicles (KVs) each having a passive sensor, said KVs configured to manage post-separation KV deployment and target engagement to execute a mission plan; and an adapter including, a support structure configured to support the KVs during launch and deploy the KVs; and a cryo cooling system configured to form an ice block on each said KV during ascent that remains with the KV post-separation to cool the passive sensor on the KV.

15. The MKV interceptor of claim 14, wherein said adapter further comprises a signal conditioning unit that supplies power to the KVs during ascent.

16. The MKV interceptor of claim 14, wherein said adapter further comprises a processor that receives and processes the mission plan for engaging the target cloud and assigns a designated target volume of the target cloud to each KV, said processor passing the full mission plan on to at least one designated master KV pre-separation.

17. A multiple kill vehicle (MKV) interceptor for intercepting targets, comprising:

a booster stage configured to provide boost and attitude control to launch the interceptor on a ballistic trajectory;

a plurality of autonomous kill vehicles (KVs); and an adapter configured to support the KVs during launch and deploy the KVs with a mission plan to engage a target cloud, wherein each said KV has a propulsion system that provides the kinematic reach and a guidance system to autonomously manage post-separation KV deployment and target engagement according to the mission plan as a designated master KV and to self-manage its own KV deployment and target engagement for a determined target volume assigned by the designated master KV without requiring updates to the mission plan post-separation.

18. The MKV interceptor of claim 17, wherein said adapter does include not propulsion and sense capability.

19. The MKV interceptor of claim 17, wherein said adapter comprises, a cryo cooling system configured to form an ice block on each said KV during ascent that remains with the KV post-separation to cool the passive sensor on the KV;

a signal conditioning unit that supplies power to the KVs during ascent; and a processor that receives and processes the mission plan for engaging the target cloud and assigns a designated target volume of the target cloud to each KV, said processor passing the full mission plan on to at least one designated master KV pre-separation.

20. The MKV interceptor of claim 17, wherein post-separation said designated master KV receives any updates to the mission plan via the adapter, updates and transmits KV deployment to the other KVs, which perform an insertion burn to mitigate insertion error and acquire the determined target volume.

21. The MKV interceptor of claim 20, wherein said designated master KV receives data on the determined target volumes from the deployed KVs, updates and transmits KV deployment back to the other KVs, which then self-manage terminal engagement of the determined target volumes.

22. An autonomous kill vehicle (KV), comprising:

a bi-directional space-to-space data link to communicate with the other KVs, an inertial measurement system configured to determine the KV's position and orientation, a passive sensor system configured to image a determine target volume of a target cloud and provide discrimination to support unambiguous assignment of targets from a mission plan, a divert attitude control system (DACS) with a kinematic reach to remove insertion error and prosecute the determined target volume, and a guidance unit configured to manage post-separation KV deployment and target engagement as a designated master KV and to self-manage its own KV deployment and target engagement for the determined target volume assigned by the designated master KV.

23. The KV of claim 22, further comprising:

a reservoir adjacent said passive sensor system, a heat exchanger coupled to said reservoir, and an input coupling for receiving cryo gas to form an ice block in said reservoir during ascent.

24. The KV of claim 22, wherein said inertial measurement system provides frame-by-frame tracking data of a target image, each KV further comprising:

a video processor that uses the existing frame-by-frame tracking data to motion compensate and temporally average multiple target images captured by the passive sensor system to generate a noise-reduced target image and to detect objects in said noise-reduced target image; and a tracker that uses the frame-by-frame tracking data to correlate noise-reduced target images with existing target tracks.

* * * * *